United States Patent [19]

Cash

[11] 4,268,987

[45] May 26, 1981

[54] HAND WEAPON FOR SURVIVAL PURPOSES

[76] Inventor: Charles Cash, Star Rte. Box 671, Kerrville, Tex. 78028

[21] Appl. No.: 70,426

[22] Filed: Aug. 29, 1979

[51] Int. Cl.[3] ..... F41C 3/00

[52] U.S. Cl. ..... 42/1 R

[58] Field of Search ..... 42/1 R, 1 G, 1 J, 1 Z

[56] References Cited

U.S. PATENT DOCUMENTS

| | | | |
|---|---|---|---|
| 975,720 | 11/1910 | Risser | 42/1 J |
| 1,436,534 | 11/1922 | Russell et al. | 42/1 Z |
| 2,042,934 | 6/1936 | Gill | 42/1 G |
| 4,083,138 | 4/1978 | Cash | 42/1 R |
| 4,176,606 | 12/1979 | King et al. | 42/1 Z |

*Primary Examiner*—Charles T. Jordan

*Attorney, Agent, or Firm*—Harvey B. Jacobson

[57] ABSTRACT

An elongated tubular barrel is provided having front and rear end portions. The rear end portion of the barrel is externally threaded and removably threadedly engaged in a forwardly opening threaded counterbore formed in an elongated breech body having a bore formed longitudinally therethrough with its forward end opening into the aforementioned counterbore. A firing pin is longitudinally received and reciprocal in the bore formed through the breech body and the rear end of the breech body includes a diametrically enlarged endwise outwardly opening counterbore. An abutment is mounted on the rear end of the firing pin and is reciprocal in the last mentioned counterbore and projects at least slightly outwardly therefrom. The abutment and rear end of the breech body include coacting structure which yieldingly resist inward movement of the abutment into the last mentioned counterbore toward a position with the forward end of the firing pin projecting out of the forward pin of the bore and into the first mentioned counterbore. The coacting structure is operable, upon a forward thrust above a predetermined magnitude being applied to the abutment, to allow the abutment to move inwardly of the counterbore in a "snap" action to thereby enable sharp engagement of the forward end of the firing pin with the primer of a cartridge received in the rear end of the barrel bore.

10 Claims, 5 Drawing Figures

HAND WEAPON FOR SURVIVAL PURPOSES

BACKGROUND OF THE INVENTION

Various forms of close combat weapons have been heretofore provided, but these close combat weapons, for the most part, may not be conveniently held within the palm of a hand and yet readily fired independent of hand or finger dexterity. In addition, some close combat weapons heretofore known and of the firearm class are constructed to require two handed operation and may thus not be as conveniently fired.

The hand weapon of the instant invention comprises an improvement over the Close Combat Backup Weapon disclosed in my prior U.S. Pat. No. 4,083,138, dated Apr. 11, 1978. The hand weapon of the instant invention includes but a minimum number of parts and may be readily constructed using relatively simple machinery.

BRIEF DESCRIPTION OF THE INVENTION

The hand weapon of the instant invention is constructed in a manner to be held in the palm of one hand of the user and includes a barrel portion adapted to extend between adjacent fingers of the associated hand. The rear end of the weapon includes an abutment which may be engaged by the palm of the hand of the user and includes a firing pin portion shiftable longitudinally relative to a breech body portion of the weapon into whose forward end the rear end of a barrel is removably threadedly engaged. The breech body and abutment include coacting structure which resists forward movement of the abutment relative to the breech body, but which allows forward movement of the abutment relative to the body portion in a "snap" action in response to a forward thrust being applied to the abutment in excess of a predetermined thrust value. The barrel portion of the hand weapon is removably threadedly engaged within a forwardly opening threaded counterbore formed in the breech body and the firing pin portion of the weapon is supported from and projects forwardly of the abutment portion and is slidable through a central bore formed through the breech body.

The main object of this invention is to provide a hand weapon for use by service personnel in close combat circumstances and which may also be used by law enforcement personnel in similar circumstances in the event they do not have immediate access to their service revolvers.

Another object of this invention is to provide a hand weapon which is extremely small in size and which may be substantially entirely enclosed within the hand of the user.

Still another object of this invention is to provide a hand weapon constructed in a manner whereby the correct "squeezing off" of a round will be substantially inherent in the operation of the hand gun.

Yet another object of this invention is to provide a hand gun of the single shot type and which may be readily altered to accept a cartridge of a different caliber merely by replacement of the barrel portion of the hand weapon, and with such replacement requiring less than 15 seconds to accomplish.

The final object of this invention to be specifically enumerated herein is to provide a hand weapon in accordance with the preceding objects and which will conform to conventional forms of manufacture, be of simple construction and easy to use so as to provide a device that will be economically feasible, long lastng and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
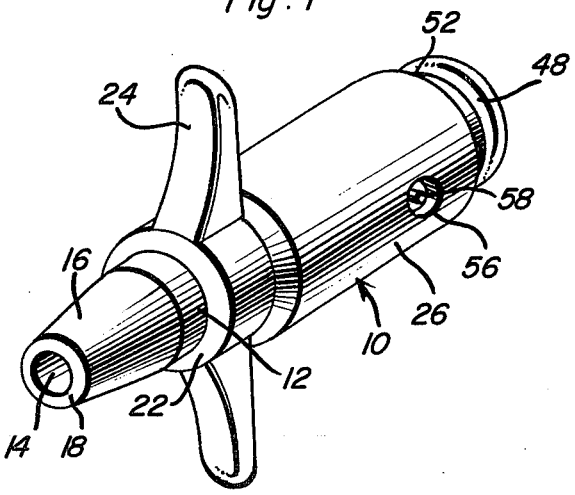
FIG. 1 is a perspective view of the hand gun of the instant invention.

Referring now more specifically to the drawings, the numeral 10 generally designates the hand weapon of the instant invention.

The hand weapon 10 includes an elongated tubular barrel 12 defining a bore 14 extending longitudinally therethrough. The wall thickness of the barrel 14 tapers forwardly as at 16 to define a relatively thin wall end 18 at the forward end of the barrel 12. The rear end of the barrel is externally threaded as at 20 and a tubular sleeve 22 constructed of a suitable material such as plastic is snugly telescoped over and slidable, but frictionally retained in position, on the barrel 12 immediately forwardly of the externally threaded rear end of the barrel. The sleeve 22 includes diametrically opposite radially outwardly projecting finger engageable abutments 24 formed integrally with the sleeve 22 and the latter may be forced forwardly toward and removed from the forward end of the barrel 12.

The weapon 10 further includes an elongated breech body 26 having a longitudinal bore 30 formed therethrough. The forward end of the bore 30 includes a diametrically enlarged threaded counterbore 32 in which the externally threaded rear end of the barrel 12 is removably threadedly engaged. The bore 30 includes a first rear counterbore 34 opening rearwardly into a second further enlarged counterbore 36 and a firing pin 38 is reciprocal in the first counter bore 34 and includes a diametrically reduced forward end 40 which projects into an is reciprocal through the bore 30. The rear end of the firing pin 38 is externally threaded as at 42 and has a cylindrical abutment 44 threadedly engaged thereon, the forward end of the abutment 44 being loosely received within the second counterbore 36.

The externally threaded rear end 42 of the firing pin 38 is threadedly received within a center threaded bore 46 formed through the abutment 44 and the rear end of the abutment 44 which projects outwardly of the second counterbore 36 is provided with a radially outwardly opening circumferential groove 48 for a purpose to be hereinafter more fully set forth. In addition, the abutment 44 includes four equally circumferentially spaced and radially outwardly opening blind bores 50 formed therein intermediate its opposite ends and each of the bores 50 includes a spring biased ball detent 52 captively retained therein but projecting outwardly from the outer ends of the bore 50.

The breech body 26 includes a transverse threaded bore 56 which intersects with the first counterbore 34 and a limit screw 58 is removably threadedly engaged in the bore 56. The limit screw 58 is thus received within the notch 60 and limits longitudinal reciprocation of the firing pin 38. In the rearward limit position of the firing pin 38 the diametrically reduced forward end portion 40 is disposed rearward of the rear inner end of the counterbore 32 and in the forward limit position of the firing pin 38 the diametrically reduced forward end 40 projects into the rear end of the counterbore 32.

The bore 32 includes an interior inwardly opening recess 62 in which a spring biased V-shaped detent 64 is retained and a plurality of notches 66 are formed in one of the convolutions of the threads 20, the detent 64 being receivable in one of the notches 66 to yieldingly resist angular displacement of the barrel 12 relative to the breech body portion 26 when the barrel 12 is fully threadedly engaged in the counterbore 32 with the end flange 67 of the shell 68 of a cartridge disposed within the bore 14 captively retained between the shoulder defined at the inner end of the counterbore 32 and the rear end face of the barrel 12.

In operation, when it is desired to chamber a cartridge within the barrel 12, the barrel 12 is removed from the breech portion 26 by unscrewing the former from the latter. Thereafter, the shell 68 of the cartridge is inserted into the rear end of the bore 14 with the flange 67 of the shell 68 abutted against the rear end of the barrel 12. Thereafter, the barrel 12 is threaded into the counterbore 32 of the breech body portion 26. Tightening of the barrel 12 within the counterbore 32 insures that the flange 67 of the shell 68 will be tightly clamped between the shoulder defined at the inner end of the counterbore 32 and the rear face of the barrel 12. Also, positioning of the barrel 12 in this manner aligns one of the notches 66 with the detent 64 whereby the latter will releasably retain the barrel 12 against being loosened relative to the breech body portion 26.

Figure 2:
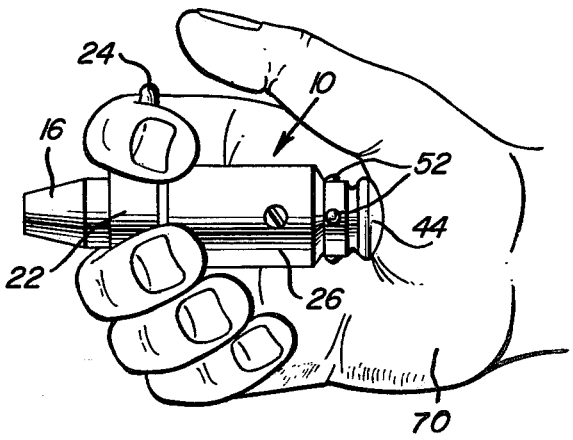
FIG. 2 is a side elevational view illustrating the manner in which the hand gun may be held in one hand in a substantially fully concealed manner.
Figure 3:
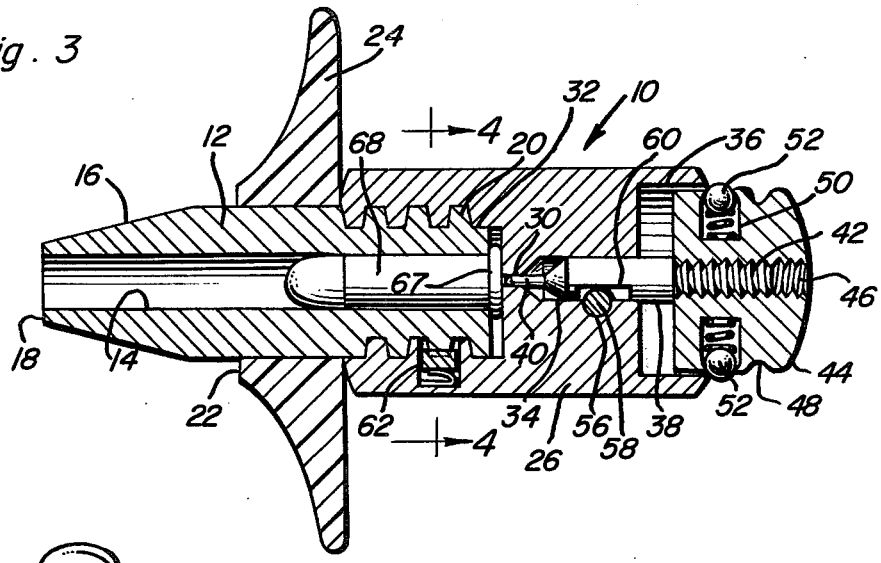
FIG. 3 is an enlarged, longitudinal, vertical sectional view taken substantially upon a plane passing along the longitudinal center line of the hand weapon.
Figure 5:
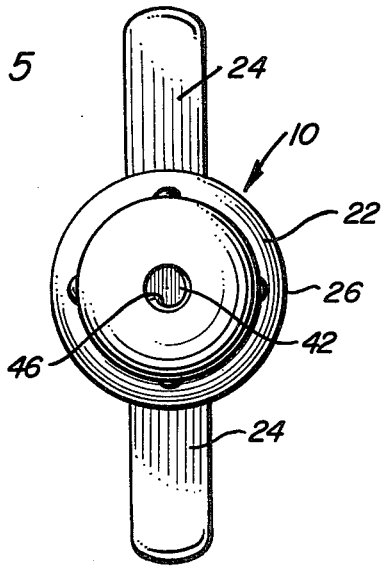
FIG. 5 is a rear elevational view of the hand weapon as seen from the right side of FIG. 3.
Figure 4:
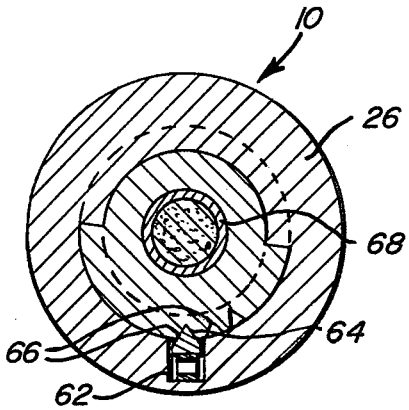
FIG. 4 is an enlarged transverse vertical sectional view taken substantially upon the plane indicated by the section line 4—4 of FIG. 3.

When the abutment 44 is positioned as illustrated in FIG. 3 of the drawings, the hand weapon 10 may be grasped in the hand 70 of the user in the manner illustrated in FIG. 2 of the drawings. Then, the user may cause his hand to squeeze the weapon 10 in a manner attempting to displace the abutments 44 and 24 toward each other. After a sufficient amount of thrust is applied, the portions of the breech body portion 26 defining the rear end of the second counterbore 36 will cam the detents 52 inwardly to allow the abutment 44 and breech body portion 26 to be relatively displaced in a "snap" action whereby the diametrically reduced forward end portion 40 of the firing pin 38 will be sharply impacted with the primer of the center fire cartridge chambered within the rear end of the bore 14. This, of course, will cause the hand weapon 10 to be fired.

The forward tapering of the barrel 12 serves the same purpose as the corresponding forward tapering of the barrel of the Close Combat Backup Weapon disclosed in my prior U.S. Pat. No. 4,038,138, but the removability of the collar 22 and the abutments 24 enables gun barrels to be readily interchanged with the breech body 26. Further, inasmuch as the collar 22 is removable, alternate collars provided with different shaped abutments may be provided in order to tailor make a forward hand grip portion for the hand weapon 10.

The groove 48 enables the rear portion of the abutment 44 to be gripped between the fingers of one hand of the user, whereby the abutment 44 and firing pin 38 may be rearwardly displaced from the "firing" positions thereof to the "cocked" positions thereof. Further, the plurality of circumferentially spaced spring biased detents 52 and the opposing portions of the breech body 26 function to guide the abutment 44 in a straight forward path toward the "firing" position from the "cocked" position, thereby preventing lateral displacement of the abutment 44 in the counterbore 36 and binding of the firing pin 38 in the counterbore 34.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be restored to, falling within the scope of the invention.

I claim:

1. A hand weapon including an elongated tubular barrel having a longitudinal bore formed therethrough and front and rear ends through which said bore opens, an elongated breech body having a longitudinal firing pin bore formed therethrough having front and rear ends, the front end of said firing pin bore including an enlarged threaded counterbore, the rear end of said barrel being externally threaded and removably threaded into said counterbore, the rear end of said firing pin bore including a diametrically enlarged rear counterbore, an elongated abutment including front and rear ends, an elongated firing pin supported and projecting outwardly from one end of said abutment, said front end of said abutment projecting into and being sliding and guidingly received in said rear counterbore with said firing pin projecting into and being slidingly received within said firing pin bore, said abutment and portions of said breech portion defining said rear counterbore including coacting means spaced about said rear counterbore and abutment yeildingly resisting inward movement of said abutment further into said rear counterbore to a position with the forward end of said firing pin projecting through said firing pin bore and into said threaded counterbore, said coacting means including structure, in response to a forward thrust on said abutment relative to said breech portion in excess of a predetermined amount to allow forward movement of said abutment relative to said breech portion in a "snap action" for sharply impacting the forward end of said firing pin with a primer of a cartridge shell seated in said threaded counterbore.

2. The combination of claim 1 wherein said abutment includes a cylindrical rear end which is slightly convex.

3. The combination of claim 1 wherein said coacting means include a plurality of radially outwardly facing and circumferentially spaced spring biased detent members captively supported from the rear end portion of said abutment and the opposing portions of said breech portion defining the rear end of said rear counterbore, said detents being engaged with said opposing portions.

4. The combination of claim 1 wherein the rear end of said abutment projects outwardly of said rear counterbore and includes a circumferentially extending radially outwardly opening groove.

5. The combination of claim 1 wherein said breech portion includes a threaded transverse bore intersecting with and slightly offset relative to the longitudinal center line of said firing pin bore, a limit screw threadedly engaged with said transverse bore and passing through one side of said firing pin bore, said firing pin including a laterally outwardly opening elongated notch formed therein in which said limit screw is received.

6. The combination of claim 1 wherein said externally threaded rear end portion of said barrel and the portions of said breech portion defining said threaded counterbore include coacting spring biased detent and recess means operable to releasably retain said barrel in substantially fully threaded seated engagement in said threaded bore.

7. The combination of claim 1 including a collar removably snugly telescoped over the forward end of said barrel and abutted against the forward end of said breech portion through which said threaded counterbore opens, said collar including radially outwardly projecting diametrically opposite abutments.

8. The combination of claim 7 wherein said collar and abutments are integrally formed of a plastic material.

9. The combination of claim 8 wherein said externally threaded rear end portion of said barrel and the opposing portions of said breech portion defining said threaded counterbore include coacting spring biased detent and recess means operable to releasably retain said barrel in substantially fully threaded seated engagement in said threaded bore.

10. The combination of claim 9 wherein said abutment includes a cylindrical rear end which is slightly convex.

* * * * *